United States Patent [19]

Tobin et al.

[11] 4,307,778

[45] Dec. 29, 1981

[54] HEAT EXCHANGE UNIT HAVING AN INTERNAL SUPPORT

[75] Inventors: Curtis L. Tobin, Chittenango; Joseph A. Ciarlei, Brewerton, both of N.Y.

[73] Assignee: Carrier Corporation, Syracuse, N.Y.

[21] Appl. No.: 139,317

[22] Filed: Apr. 11, 1980

[51] Int. Cl.[3] ..... F24F 7/007

[52] U.S. Cl. ..... 165/125

[58] Field of Search ..... 165/125, 144, 145, 67, 165/68

[56] References Cited

U.S. PATENT DOCUMENTS

| | | | |
|---|---|---|---|
| 2,056,041 | 9/1936 | Erbach | 165/125 |
| 2,159,913 | 5/1939 | Tenney | 165/125 |
| 2,260,594 | 10/1941 | Young | 165/125 |
| 2,524,226 | 10/1950 | Higham | 165/125 |
| 2,697,428 | 12/1954 | Norman, Jr. et al. | 165/125 |
| 4,202,409 | 5/1980 | Cann et al. | 165/125 |

FOREIGN PATENT DOCUMENTS

| | | | |
|---|---|---|---|
| 622057 | 2/1927 | France | 165/125 |
| 59582 | 5/1968 | German Democratic Rep. | 165/125 |

*Primary Examiner*—Sheldon J. Richter

*Attorney, Agent, or Firm*—J. Raymond Curtin; Robert P. Hayter

[57] ABSTRACT

A heat exchange unit and internal support therefor are disclosed. The internal support is bowl shaped and has portions for the support of fan means, an inner heat exchanger and an outer heat exchanger. An air inlet portion in the support allows air to be circulated therethrough by the fan means. A base pan having an air inlet portion allows air to enter the interior of the unit such that there is a separate air flow path for each heat exchanger, both air flow paths including flow through the air inlet portion of the internal support.

7 Claims, 3 Drawing Figures

HEAT EXCHANGE UNIT HAVING AN INTERNAL SUPPORT

BACKGROUND OF THE INVENTION

1. Field of the Invention

This invention in general relates to heat exchange units and more particularly to an internal support adapted to serve several functions within a heat exchange unit.

2. Prior Art

A heat exchange unit, as may be used in an air conditioning or refrigeration application, is typically designed to have a heat exchanger and a fan for circulating heat transfer media, typically air, in heat exchange relation with a fluid flowing through the heat exchanger. In many applications such as air conditioning the heat exchange unit is mounted exterior of the enclosure to be conditioned to transfer heat energy between refrigerant used for heating or cooling the air of the residence and ambient air flowing in heat transfer relation with the outdoor heat exchanger.

A fan is usually mounted to circulate air through the heat exchanger of the unit. The fan provides a forced air flow to promote heat transfer between the air and the refrigerant flowing through the outdoor heat exchanger.

It has been found that in some applications, it is more efficient to use multiple heat exchangers in the heat exchange unit. These multiple heat exchangers may be mounted side by side such that air entering the unit flows first through one heat exchanger and then the other heat exchanger. Mounting in this arrangement acts to decrease the heat transfer efficiency of the inner heat exchanger since the ambient air flowing in heat exchange relation therewith has already had its temperature raised or lowered by the outer heat exchanger. Consequently, the temperature difference between the air and the refrigerant flowing through the inner heat exchanger is lowered and the overall heat transfer efficiency of the inner heat exchanger is thereby decreased.

Another method for providing multiple heat exchangers is to stack one on top of the other such that ambient air flows directly through both. The disadvantage of this type of system is the large heat exchange unit size required.

The present heat exchanger arrangement provides for two heat exchangers in a single unit, each having ambient air flow directly therethrough. The heat exchangers are mounted such that air flows directly through the outer heat exchange unit and is discharged from the unit by the fan. Air flows into the unit through an air inlet segment of the base pan and then through the inner heat exchanger and again is discharged from the unit by the fan. Consequently, a unit has been provided having two separate air flow paths, one for each heat exchanger.

The unit support as claimed herein is a bowl shaped support member having portions to connect to each heat exchanger. Additionally provided is a fan motor support portion in the center thereof and air flow openings located between the two heat exchangers. The fan is mounted such that the fan blades draw air through the air inlet portions between the two heat exchangers creating two separate air flow paths, one for each of the heat exchangers.

SUMMARY OF THE INVENTION

It is an object of the present invention to provide an internal support for a heat exchange unit.

It is a further object of the present invention to have an internal support capable of supporting multiple heat exchangers located in different positions in a single heat exchange unit.

It is a further object of the present invention to not only provide a multiple heat exchanger support but to direct air flow therethrough and to support the fan means for circulating the air relative to the heat exchangers.

It is a further object of the present invention to provide a single integral support for serving numerous functions in a heat exchange unit.

It is another object of the present invention to provide a safe, economical, reliable and easy to manufacture support for a heat exchange unit.

Other objects will be apparent from the description to follow and the appended claims.

These and other objects are achieved in accordance with the preferred embodiment of the present invention wherein there is provided a heat exchange unit having a base with support means located about the periphery thereof. An outer heat exchanger is mounted in conjunction with the support means and extends generally vertically therefrom. An inner heat exchanger is likewise mounted in conjunction with the support means and extends at an angle inwardly therefrom. The unit support is a bowl shaped support member being adapted to connect to the outer heat exchanger and the inner heat exchanger. An air inlet portion is provided in the unit support between the portions connecting the two heat exchangers such that air may flow through both heat exchangers and be directed through the air inlet portion. The support further has a motor portion adapted to be connected to and support a fan motor and fan. The fan motor is positioned relative to the air inlet openings to promote air flow therethrough. The unit support may additionally include a fan orifice operating in conjunction with a propeller fan to promote efficient air flow.

DESCRIPTION OF THE PREFERRED EMBODIMENT

The embodiment hereinafter described will refer to a heat exchange unit as is adapted to be mounted as the outdoor heat exchanger of a residential air conditioning system. It is to be understood that this support and heat exchange unit apply to other applications and other configurations wherein a heat exchange unit is required. It is further to be understood that this support may be adapted to a heat exchanger which may be utilized in a cooling only air conditioning system or in a heat pump application. This internal support for a heat exchange unit has applicability to various types of units including but not limited to a self contained unit having a compressor, circuiting and both an evaporator and condenser or to a simple heat exchange unit having but a fan and heat exchanger.

Figure 1:
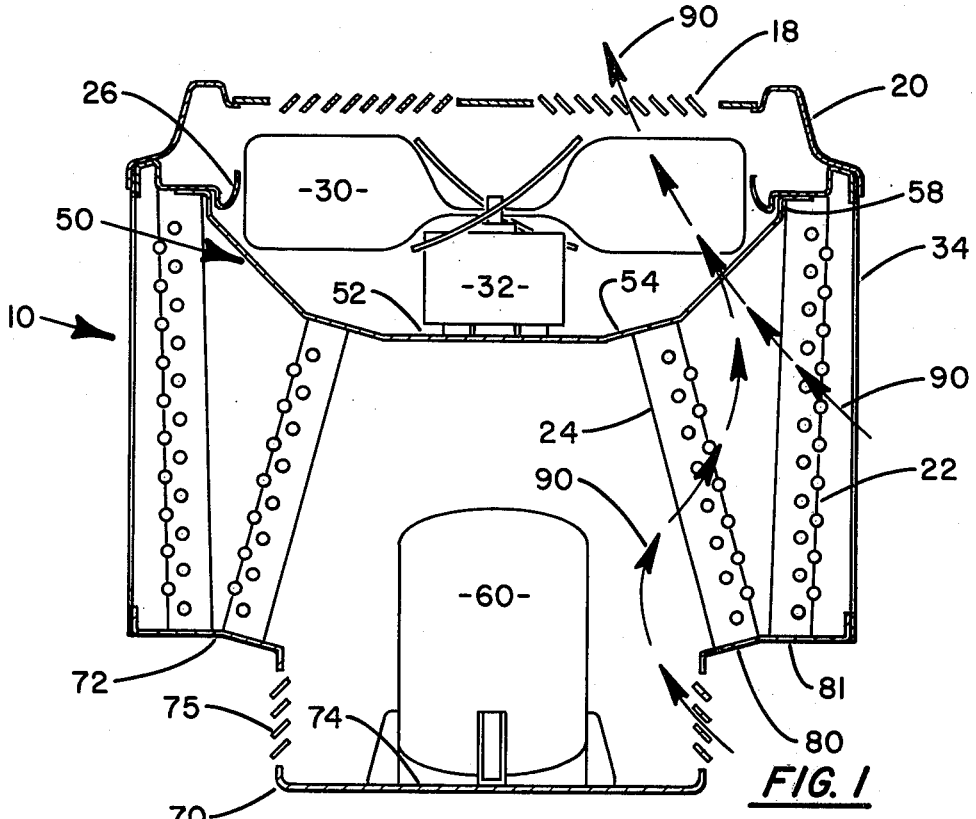
FIG. 1 is a schematic view of an air conditioning unit having an integral unit support.

Referring first to FIG. 1 there may be seen a schematic view of a heat exchange unit. Base pan 70 at the bottom of the unit is adapted to support the unit and has a unit support portion 74 which may be placed on a concrete pad or other support upon which the unit is mounted. Base pan 70 has an air inlet portion 75 and a coil support portion 72. Coil support portion 72 is divided into a first coil support portion 81 located to support the outer heat exchanger 22 and a second coil support portion 80 located to support the inner heat exchanger 24. Compressor 60 is shown within the unit mounted to the base pan 70.

The unit, as shown in FIG. 1, is generally annular in configuration as are the two heat exchangers. Outer heat exchanger 22 extends generally vertically from the coil support portion of the base pan about the periphery of the unit. Grille 34 may be mounted at the extreme outer edge of the unit to prevent foreign objects from contacting the outer heat exchanger 22.

Unit support 50 is formed in a bowl shaped configuration. Unit support 50 has a motor support portion 52 located in the center thereof. Motor support portion 52 is solid and may have motor supports 33 affixed thereto for coacting with fan motor 32. In a typical application the fan motor bolts may be screwed into the motor supports 33 to secure the fan motor thereto. Connected to the motor portion 52 of the unit support is inner heat exchange portion 54. Inner heat exchange portion 54 is slightly inclined to motor portion 52 and is adapted to support the top of the inner heat exchanger 24.

Connected to inner heat exchange portion 54 and angled upwardly therefrom is air inlet portion 56. Air inlet portion 56 has air inlet openings 55 therethrough through which heat transfer media may pass. Connected to air inlet portion 56 is outer heat exchange portion 58 which is adapted to be connected to support the top of outer heat exchanger 22. Outer coil attachment openings 59 are located in the outer heat exchange portion 58 for attachment to the outer heat exchanger. Likewise inner coil attachment openings 57 as may be seen in FIG. 2 provide means for securing the inner heat exchange portion 54 of the unit to the inner heat exchanger 24.

Fan motor 32 having propeller fan 30 is shown in FIG. 1 mounted to motor portion 52 of the unit support. The fan blades of fan 30 coact with fan orifice 26 to provide proper air flow characteristics through the unit. It can be seen that the fan blades of the fan are located in close proximity to the fan orifice and are located relative to the air inlet portion 56 of the unit support such that the air is drawn through the air inlet openings 55 in the air inlet portion. Cover 20 is mounted at the top of outer heat exchanger 22 to seal the top of the unit. Horizontal grille 18 is supported in the top of the unit by cover 20 and provides a means for air to be discharged from the unit.

During operation of this unit, the fan motor is energized and the fan blades 30 rotate causing air to circulate through the unit. As are shown by arrows 90, air circulates through vertical grille 34 through outer heat exchanger 22 through the air inlet portion 56 of the unit support and is discharged through horizontal grille 18 of the unit. Likewise, air flow is through the air inlet segment 75 of the base pan, through the interior of the unit, through inner heat exchanger 24 to the air inlet portion 56 of the unit support and again out of the unit through horizontal grille 18. Hence, it can be seen that separate flow paths are provided for ambient air through each heat exchanger. It can be likewise seen that the heat exchangers, inner heat exchanger 24 and outer heat exchanger 22, are mounted such that the bottom ends thereof are in close proximity to each other. The top ends of the two heat exchangers are spaced from each other such that a space is provided between the two heat exchangers. It is to this space that air is drawn through both heat exchangers by fan 30.

Figure 2:
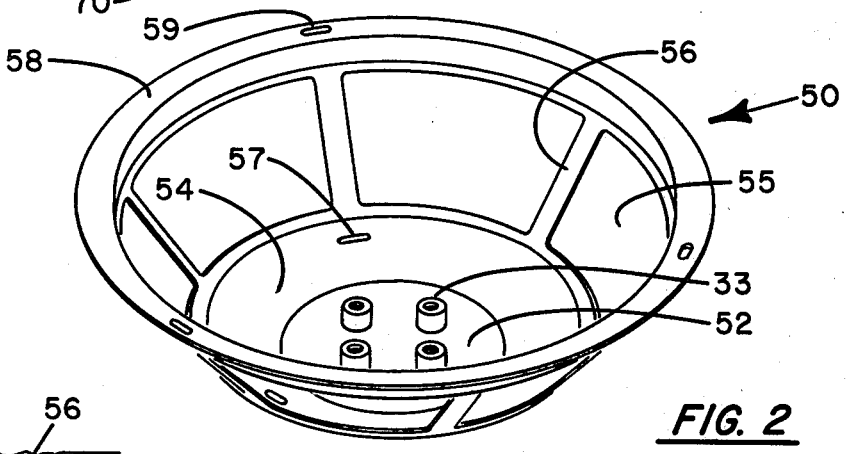
FIG. 2 is an isometric view of the unit support.

FIG. 2 shows an isometric view of the various portions of the unit support 50 as hereinabove described.

Figure 3:
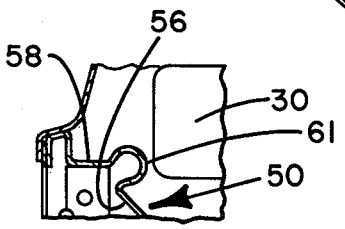
FIG. 3 is a cutaway portion of a schematic view showing a fan orifice incorporated as a part of the unit support.

FIG. 3 is a partial view of unit support 50 showing air inlet portion 56 and outer heat exchange portion 58. Fan blades 30 are shown mounted relative to these two portions such that the outer heat exchange portion 58 has a fan orifice surface 61 coating with fan blade 30 to provide a fan orifice. The provision of this surface as part of the unit support acts to eliminate the need for a separate fan orifice as is shown in FIG. 1.

The herein invention has been described with reference to a particular embodiment. It is to be understood by those skilled in the art that various changes and modifications may be made and equivalents substituted for the elements thereof without departing from the scope of the invention.

We claim:

1. A heat exchange unit which comprises:

a base for supporting the heat exchange unit including support means arranged about a portion of the periphery of the base;

a generally vertically extending heat exchanger mounted about a portion of the periphery of the unit in conjunction with the support means of the base;

a unit support having a generally bowl shaped configuration, said support extending between and connecting portions of the heat exchanger and said unit support including an outer heat exchange portion adapted to be connected to the heat exchanger, an air inlet portion connected to the outer heat exchange portion and having air inlet openings extending therethrough, and a solid center portion connected to the air inlet portion; and fan means mounted to the solid center portion of the unit support to cause air to circulate through the air inlet portion of the heat exchange unit by flowing through the heat exchanger and then through the openings of the unit support.

2. The apparatus as set forth in claim 1 wherein the unit support further includes a fan orifice portion mounted to the outer heat exchange portion and wherein the fan means includes at least one fan blade rotating in relation to the fan orifice portion of the unit support.

3. A heat exchange unit which comprises:

a base for supporting the heat exchange unit, said base including support means located about the periphery thereof;

an outer generally vertically extending heat exchanger mounted about a portion of the periphery of the unit in conjunction with the support means of the base;

an inner heat exchanger mounted in conjunction with the support means of the base;

a unit support having an outer heat exchange portion connected to support the outer heat exchanger, an inner heat exchange portion connected to support the inner heat exchanger and an air inlet portion connecting the outer heat exchange portion to the inner heat exchange portion, said air inlet portion having air flow openings extending therethrough; and fan means for circulating air through both the outer heat exchanger and the air flow openings and through the inner heat exchanger and the air flow openings.

4. The apparatus as set forth in claim 3 wherein the unit support is generally bowl shaped and has a fan support portion connected to the inner heat exchange portion, said fan support portion being adapted to have the fan means mounted thereto.

5. The apparatus as set forth in claim 4 wherein the fan means includes a propeller type fan and a motor to power said fan, wherein the fan is mounted to the fan support portion of the unit support, said fan acting to circulate air through both heat exchangers and through the air inlet portion of the unit support.

6. The apparatus as set forth in claim 5 wherein the bottom of the outer heat exchanger is mounted in close proximity to the bottom of the inner heat exchanger, wherein the top of the outer heat exchanger is mounted relatively distant from the top of the inner heat exchanger whereby air may flow through both heat exchangers to the space therebetween and then through the air inlet portion of the unit support.

7. The apparatus as set forth in claim 6 wherein the air circulated through the inner heat exchanger enters the heat exchange unit through an air inlet segment of the base, said air inlet segment being located interior of the inner heat exchanger.

* * * * *